United States Patent [19]

Kuzminski

[11] 4,296,189

[45] Oct. 20, 1981

[54] COLOR PICTURE TUBE HAVING IMPROVED SLIT TYPE SHADOW MASK AND METHOD OF MAKING SAME

[75] Inventor: Henry W. Kuzminski, Ephrata, Pa.

[73] Assignee: RCA Corporation, New York, N.Y.

[21] Appl. No.: 207,781

[22] Filed: Nov. 17, 1980

Related U.S. Application Data

[62] Division of Ser. No. 41,998, May 24, 1979.

[51] Int. Cl.[3] ..... G03C 5/00

[52] U.S. Cl. ..... 430/5; 29/25.17; 313/403; 313/408; 354/1; 355/132; 355/133; 430/23; 430/321; 430/323; 430/396

[58] Field of Search ..... 430/4, 5, 23, 321, 323, 430/396; 313/403, 408, 453; 354/1; 355/133, 132; 29/25.17

[56] References Cited

U.S. PATENT DOCUMENTS

| | | | |
|---|---|---|---|
| 3,652,895 | 3/1972 | Tsunetta et al. | 313/85.9 |
| 3,731,129 | 5/1973 | Tsunetta et al. | 313/855 X |
| 3,766,419 | 10/1973 | Barbin | 313/348 X |
| 3,834,905 | 9/1974 | Dodd et al. | 355/71 X |
| 3,882,347 | 5/1975 | Suzuki et al. | 313/403 |
| 3,883,770 | 5/1975 | Yamada et al. | 313/403 |
| 3,973,965 | 8/1976 | Suzuki et al. | 29/25.17 X |
| 4,077,717 | 3/1978 | Lange | 355/133 |
| 4,159,177 | 6/1979 | Elshof et al. | 430/5 X |
| 4,168,450 | 9/1979 | Yamauchi et al. | 313/403 |

*Primary Examiner*—Edward C. Kimlin

*Attorney, Agent, or Firm*—Eugene M. Whitacre; Glenn H. Bruestle; Dennis H. Irlbeck

[57] ABSTRACT

A color picture tube having a slit type apertured mask, wherein the slit apertures are arranged in columns and the apertures in each column are separated by webs is improved by increasing the radius of curvature of the ends of the apertures at the webs to substantially greater than half the width of the central portions of the respective apertures. Such aperture shape may be achieved by a method wherein the aperture images of a photomaster used in fabricating the mask have greater width at the ends thereof than at the centers of the aperture images.

2 Claims, 12 Drawing Figures

COLOR PICTURE TUBE HAVING IMPROVED SLIT TYPE SHADOW MASK AND METHOD OF MAKING SAME

This is a division of application Ser. No. 041,998, filed May 24, 1979.

BACKGROUND OF THE INVENTION

This invention relates to color picture tubes and particularly to such tubes having a slit type apertured mask.

Shadow mask type color picture tubes usually include a screen of red, green and blue emitting phosphor lines or dots, electron gun means for exciting the screen and a shadow mask interposed between the gun means and the screen. The shadow mask is a thin multiapertured sheet of metal precisely disposed adjacent the screen so that the mask or apertures are systematically related to the phosphor lines or dots.

Color picture tubes having shadow masks with slit shaped apertures have received relatively recent commercial acceptance. One of the reasons for this acceptance is that the percentage of electron beam transmission through the mask can be made higher for a slit-mask, line-screen type of tube than for a circular-apertured mask, dot-screen type tube. Even though the use of a slit mask provides a definite advantage in electron beam transmission, the percentage of electron beam transmission through a slit mask can be increased even further than is practiced in the present art.

In one type of slit shadow mask, the mask has vertically extending slit apertures which are interrupted by a plurality of spaced bridges or webs which provide mechanical rigidity. The presence of these webs, however, has an effect on electron beam transmission and thus on luminescent brightness.

FIG. 1 shows a portion of a prior art shadow mask 10 having slit shaped apertures 12 wherein the slit apertures 12 are arranged in columns and the apertures in each column are separated by webs 14. Each aperture 12 has an elongated shape with curved ends. Generally, the curvature of each end has a radius approximately equal to half the width of an aperture measured in the center of the aperture. Such curved aperture shape at the webs occurs because of the etching process. Apertured masks are formed by first coating a metal sheet with a photosensitive material, exposing the photosensitive material through a photomaster having a desired aperture pattern thereon and thereafter etching the metal sheet to open the apertures. Most prior art photomasters have rectangularly shaped elements at the locations of the intended apertures. Unfortunately, during etching, the shape of the apertures become rounded at the ends of the apertures instead of being formed as rectangles. Because of this rounding, some electron beam transmission is lost in the corners of the apertures as illustrated by the shaded areas 16 of FIG. 2 which shows the shape of a photomaster element 18 superimposed on its resultant aperture 20. It is, therefore, desirable to develop an aperture pattern which, when etched, will form more nearly rectangular apertures thereby permitting increased electron beam transmission.

SUMMARY OF THE INVENTION

A color picture tube having a slit type apertured mask, wherein the slit apertures are arranged in columns and the apertures in each column are separated by webs is improved by increasing the radius of curvature of the ends of the apertures at the webs to substantially greater than half the width of the central portions of the respective apertures. Such aperture shape may be achieved by a method wherein the aperture images of a photomaster used in fabricating the mask have greater width at the ends thereof than at the centers of the aperture images.

DETAILED DESCRIPTION OF THE PREFERRED EMBODIMENTS

Figure 1:
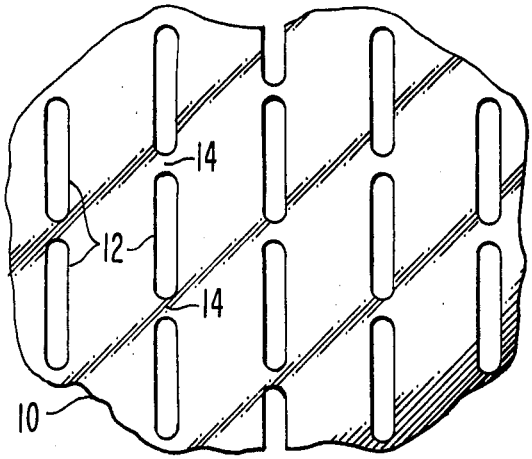
PRIOR ART Fig. 1.
FIG. 1 is a plan view of a portion of a prior art shadow mask.
Figure 3:
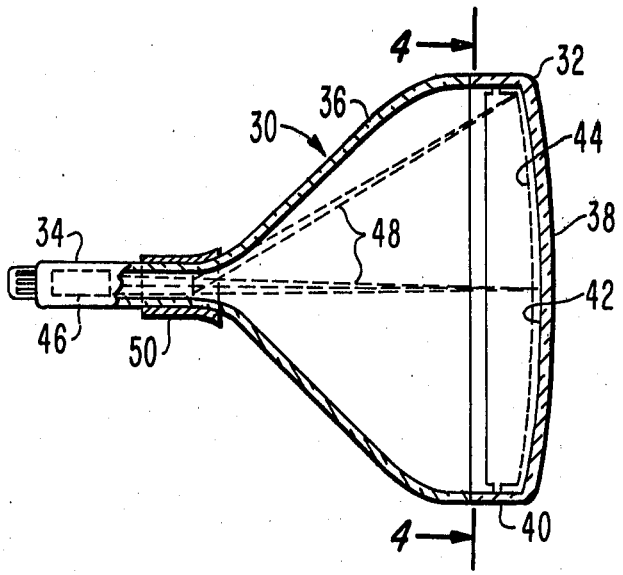
FIG. 3 is a plan view, partly in axial section, of a shadow mask type color picture tube.
Figure 4:
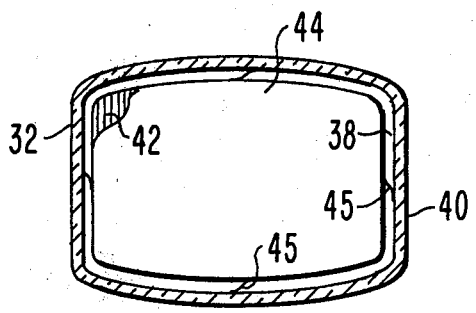
FIG. 4 is a rear view, partly cut away of a tube faceplate assembly taken at lines 4—4 of FIG. 3.
Figure 7:
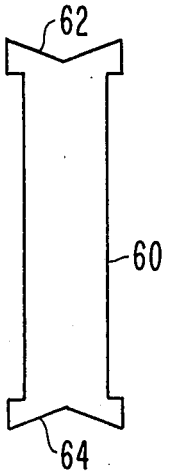
FIGS. 7–12 are plan views of other novel photomaster elements used in generating slit apertures.
Figure 8:
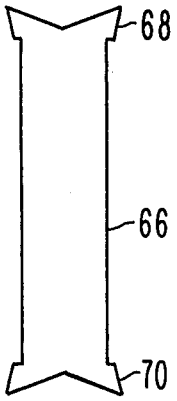

FIGS. 3 and 4 illustrate a rectangular color picture tube having a glass envelope 30 comprising a rectangular faceplate panel or cap 32 and a tubular neck 34 connected by a rectangular funnel 36. The panel comprises a viewing faceplate 38 and a peripheral flange or sidewall 40 which is sealed to the funnel 36. A mosaic three-color phosphor screen 42 is carried by the inner surface of the faceplate 38. The screen 42 is a line screen with the phosphor lines extending substantially parallel to the central vertical axis of the tube (normal to the plane of FIG. 3). An improved domed multi-apertured color selection electrode or shadow mask 44 is removably mounted within the panel 32 by four springs 45 in predetermined spaced relation to the screen 42. An inline electron gun 46, shown schematically by dotted lines in FIG. 1, is centrally mounted within the neck 34 to generate and direct three electron beams 48 along coplanar convergent paths through the mask 44 to the screen 42. The mask 44 serves a color selection function by shadowing, or masking, each electron beam from the nonassociated color emitting phosphor lines, shile permitting them to strike their associated lines. A magnetic deflection yoke 50 is positioned on the envelope 30 near the intersection of the funnel 36 and the neck 34. When suitably energized, the yoke 50 causes the electron beams 48 to scan the screen 42 in a rectangular raster.

Figure 5:
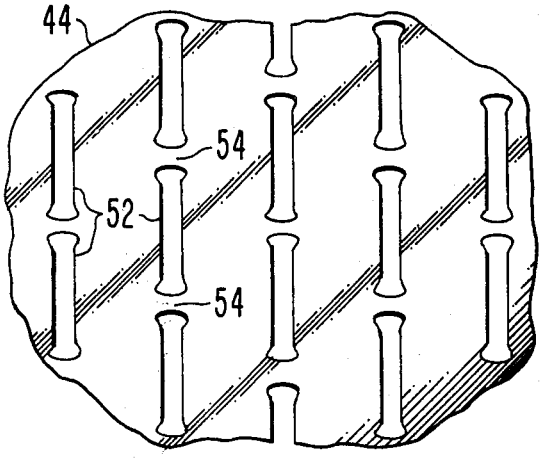
FIG. 5 is a plan view of a portion of a shadow mask having novel shaped apertures therein.

Details of a portion of the shadow mask 44, which includes apertures 52 having a novel shape, are shown in FIG. 5. The apertures 52 are elongated rectangular slits vertically aligned in columns. The columns are substantially parallel to each other, although they can also bow outwardly at the left and right sides of the mask as is known in the art. The slits 52 in each column are separated from each other by bridges or webs 54 which connect the unapertured portions of the mask to provide the structural integrity required to maintain the domed contour of the mask.

Figure 2:
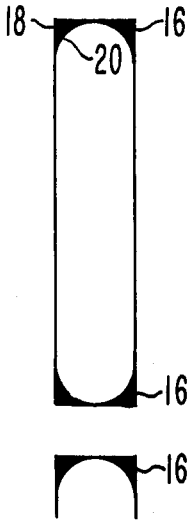
PRIOR ART Fig. 2.
FIG. 2 is a plan view of a prior art photomaster element overlaying a resultant prior art aperture.

The slit apertures 52 of the mask 44 appear to have a dogbone or dumbbell shape being slightly wider at their ends than in the middle section. The ends of the slit apertures 52 at the webs 54 are curved having a radius of curvature much larger than the ends of the prior art apertures shown in FIG. 1. In the prior art apertures, this radius of curvature is approximately equal to half the width of the aperture whereas with the present novel slit aperture 52 the end radius is substantially greater than half the width of the central portions of the apertures. Because of this larger radius at the ends of the apertures 52, the apertures are more nearly rectangular, whereby much of the shaded areas 16 of the FIG. 2 prior art aperture shape are open, thereby permitting increased electron beam transmission at the webs.

Figure 6:
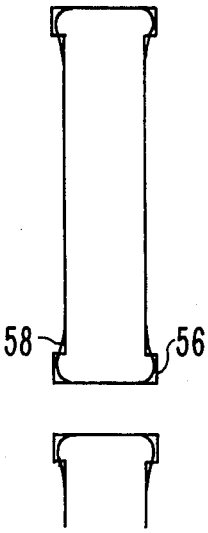
FIG. 6 is a plan view of a novel photomaster element overlaying a resultant novel aperture.

Aperture shapes, such as the foregoing dogbone shape, are generated by varying the aperture image of a photomaster element to resemble an I-shape wherein the top and bottom of each element is made wider than the remainder of the element. FIG. 6 shows the shape of an I-shaped photomaster element 56 overlaying a resultant aperture 58.

Figure 9:
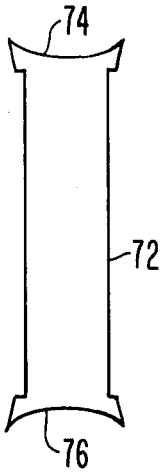
Figure 10:
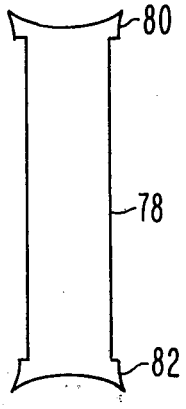

Variations may be made in the basic I-shape of the photomaster elements to modify the resultant aperture shapes. Some of these variations are shown in FIGS. 7–12. In the photomaster element 60 of FIG. 7, the top and bottom ends 62 and 64 of the I-shape are notched to further reduce the amount of rounding at the top and bottom of a resultant aperture. The photomaster element 66, shown in FIG. 8, includes beveled ends, 68 and 70, of the cross portions of the I-shape to reduce the width of the apertures at their ends. FIGS. 9 and 10 represent the inclusion of minor corrections that can be made to either or both of the embodiments of FIGS. 7 and 8, to fine tune the photomaster element shapes to obtain a more nearly rectangular aperture shape. In the photomaster element 72 of FIG. 9, the ends 74 and 76 are concavely curved rather than notched, and in the photomaster element 78 of FIG. 10, the beveled ends, 80 and 82, of the cross portions are slightly concavely curved. In each of these two cases, the slight curvature permits a fine tuning of the resultant aperture shape to at least approach a rectangular shape.

Figure 11:
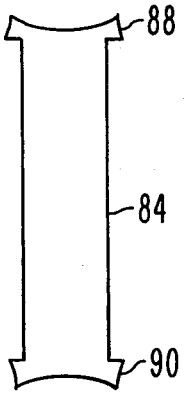
Figure 12:
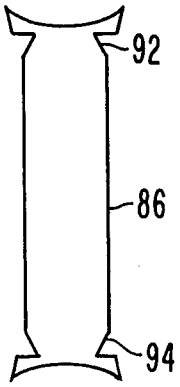

The photomaster element shapes, 84 and 86 of FIGS. 11 and 12, respectively, provide two ways in which to further reduce the outward bowing of the apertures at the ends of the apertures. In FIG. 11, the angle of the bevel at the ends, 88 and 90, of the cross portions of the I-shapes are reversed and in FIG. 12 notches, 92 and 94, are placed in the photomaster element next to the cross portions.

I claim:

1. In a method of making a color picture tube having a slit type apertured mask, wherein the slit apertures are arranged in columns and the apertures in each column are separated by webs, said mask being formed by coating a metal sheet with a photosensitive material, exposing the photosensitive material through a photomaster having an apertured pattern thereon and thereafter etching the metal sheet to form apertures therein, the improvement comprising exposing said metal sheet through a photomaster having aperture images thereon which have greater width at the ends thereof than at the central portions of the aperture images, whereby upon etching said metal sheet apertures are generated therein which are more nearly rectangular than are apertures formed in a mask which was exposed by a photomaster having rectangular aperture images.

2. The method as defined in claim 1 wherein the aperture images in said photomaster have an I-shaped configuration.

* * * * *